US009372458B2

(12) United States Patent
Misao et al.

(10) Patent No.: US 9,372,458 B2
(45) Date of Patent: Jun. 21, 2016

(54) IMAGE FORMING APPARATUS THAT PROTECTS A HEATER FROM ELECTRICAL BREAKDOWN

(75) Inventors: Yoji Misao, Susono (JP); Kazunari Nishimoto, Numazu (JP); Kazushi Nishikata, Odawara (JP); Shotaro Yoshimura, Mishima (JP); Tomoya Kuruma, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 481 days.

(21) Appl. No.: 13/542,486

(22) Filed: Jul. 5, 2012

(65) Prior Publication Data

US 2013/0011156 A1 Jan. 10, 2013

(30) Foreign Application Priority Data

Jul. 8, 2011 (JP) ..... 2011-151922
Jun. 13, 2012 (JP) ..... 2012-134111

(51) Int. Cl.
*G03G 15/00* (2006.01)
*G03G 15/20* (2006.01)

(52) U.S. Cl.
CPC ..... *G03G 15/2064* (2013.01); *G03G 15/80* (2013.01); *G03G 2215/2035* (2013.01)

(58) Field of Classification Search
CPC ..... G03G 21/1661
USPC ..... 399/88, 329, 328
See application file for complete search history.

(56) References Cited

U.S. PATENT DOCUMENTS

| | | | | |
|---|---|---|---|---|
| 5,404,214 | A | 4/1995 | Yoshimoto | |
| 2001/0032835 | A1* | 10/2001 | Murooka et al. | 219/216 |
| 2011/0011611 | A1* | 1/2011 | Hyde et al. | 174/2 |

FOREIGN PATENT DOCUMENTS

| | | | |
|---|---|---|---|
| CN | 2152327 | Y | 1/1994 |
| JP | 4-362660 | A | 12/1992 |
| JP | 5-37137 | A | 2/1993 |
| JP | 6-051659 | A | 2/1994 |
| JP | 11-74626 | A | 3/1999 |
| JP | 2004-79529 | A | 3/2004 |
| JP | 2010-014864 | A | 1/2010 |
| JP | 2010-164636 | A | 7/2010 |

OTHER PUBLICATIONS 12.2 Surge Arresters, publication date Dec. 27, 1999, onlinelibrary.wiley.com DOI: 10.1002/047134608X.W6207.*
IEEE Definitions; published 2000, IEEE 100 The Authoritation of Dictionary of IEEE Standard Terms, seventh edtion, 2000.*

* cited by examiner

*Primary Examiner* — Quana M Grainger
(74) *Attorney, Agent, or Firm* — Canon USA Inc. IP Division

(57) ABSTRACT

In an image forming apparatus including a fixing unit having a film and a heater in contact with the inner surface of the film, an electrical breakdown may occur in the protection layer of the heater, when a surge voltage is applied to a power supply line connected to the heater. An arrester is provided on a power supply line connected to the heater of the image forming apparatus.

16 Claims, 8 Drawing Sheets

F.G.

IMAGE FORMING APPARATUS THAT PROTECTS A HEATER FROM ELECTRICAL BREAKDOWN

BACKGROUND OF THE INVENTION

1. Field of the Invention

The present invention relates to image forming apparatuses having a fixing unit that heats a recording material carrying a toner image to fix the toner image onto the recording material.

2. Description of the Related Art

In recent years, fixing units employing a film-heating method, which serve as fixing units installed in electrophotographic image forming apparatuses, such as copiers and laser beam printers, are being proposed.

This fixing unit includes a tubular film, a heater in contact with the inner surface of the film, and a pressing roller that forms a nip with respect to the heater via the film. The heater has a heat generating resistor that is disposed on a substrate and generates heat by receiving a supply of power, and a glass protection layer for protecting the heat generating resistor. At the nip, the recording material is heated while being conveyed, thereby fixing the toner image onto the recording material.

However, in the case where the heater is connected to a frame ground (hereinbelow, FG) of the apparatus via the film and the pressing roller, the above-described fixing unit employing a film-heating method has the following problem.

That is, if a surge voltage due to lightning is applied between a power supply line connected to the heater of the fixing unit and the FG, a high-potential surge voltage is applied to the heater, which may cause an electrical breakdown in the protection layer of the heater.

To overcome the above-described problem, Japanese Patent Laid-Open No. 6-051659 discloses a configuration in which a resistor is connected between a pressing roller and an FG. This configuration can divide and reduce the voltage applied to the protection layer of the heater when a surge voltage is applied between the power supply line and the FG, and hence, prevents an electrical breakdown.

However, in the configuration disclosed in Japanese Patent Laid-Open No. 6-051659, the clearance between the film and the FG, such as a metal frame, or the clearance between the pressing roller and the FG, such as a metal frame, must be sufficiently large to prevent a discharge from occurring when a surge voltage is applied.

That is, the above-described clearance must be set such that the impedance of a path in which a discharge occurs across the clearance between the film and the metal frame and leads to the FG is larger than the impedance of a path leading from the pressing roller to the FG via the resistor.

This is because, if a discharge occurs between the film and the metal frame, the advantage achieved by the resistor provided between the pressing roller and the FG to divide the voltage cannot be obtained, and a high-potential surge voltage may be applied to the protection layer of the heater, causing an electrical breakdown.

Thus, the configuration disclosed in Japanese Patent Laid-Open No. 6-051659 involves an increase in size of the apparatus to avoid an electrical breakdown in the protection layer.

SUMMARY OF THE INVENTION

According to an aspect disclosed herein, an image forming apparatus configured to form an image on a recording material includes: an image forming unit configured to form a toner image on the recording material; a fixing unit configured to fix the toner image onto the recording material by heating the recording material provided with the toner image at a nip while conveying the recording material, the fixing unit including a tubular film, a heater in contact with an inner surface of the film, and a pressing member that forms the nip with the heater via the film; a power supply line for supplying power to the heater; and an arrester provided on the power supply line.

According to another aspect disclosed herein, an image forming apparatus configured to form an image on a recording material, the apparatus including: an image forming unit configured to form a toner image on the recording material; a fixing unit configured to fix the toner image onto the recording material by heating the recording material provided with the toner image at a nip while conveying the recording material, the fixing unit including a tubular film, a heater in contact with an inner surface of the film, and a pressing member that forms the nip with the heater via the film; a power supply line for supplying power to the heater; and an arrester that includes a first electrode connected to the power supply line, and a second electrode that is disposed at a predetermined clearance away from the first electrode and is connected to an electrical ground.

The present invention prevents an electrical breakdown in the protection layer of the heater in contact with the inner surface of the film in the fixing unit, while reducing the size of the apparatus.

Further features of the present invention will become apparent from the following description of exemplary embodiments with reference to the attached drawings.

DESCRIPTION OF THE EMBODIMENTS

First Embodiment

Figure 1A:
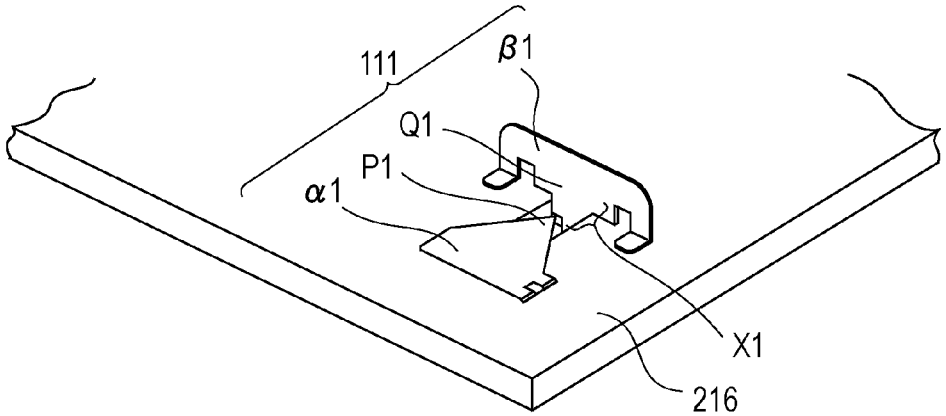
FIG. 1A is a diagram showing, in outline, an arrester according to a first embodiment.

Referring to the drawings, an electrophotographic laser beam printer, which is an embodiment of an image forming apparatus of the present invention, will be described below. Unless otherwise specifically noted, the dimensions, materials, shapes, and relative positions of components described in this embodiment are not intended for limiting the scope of the invention.

Figure 4:
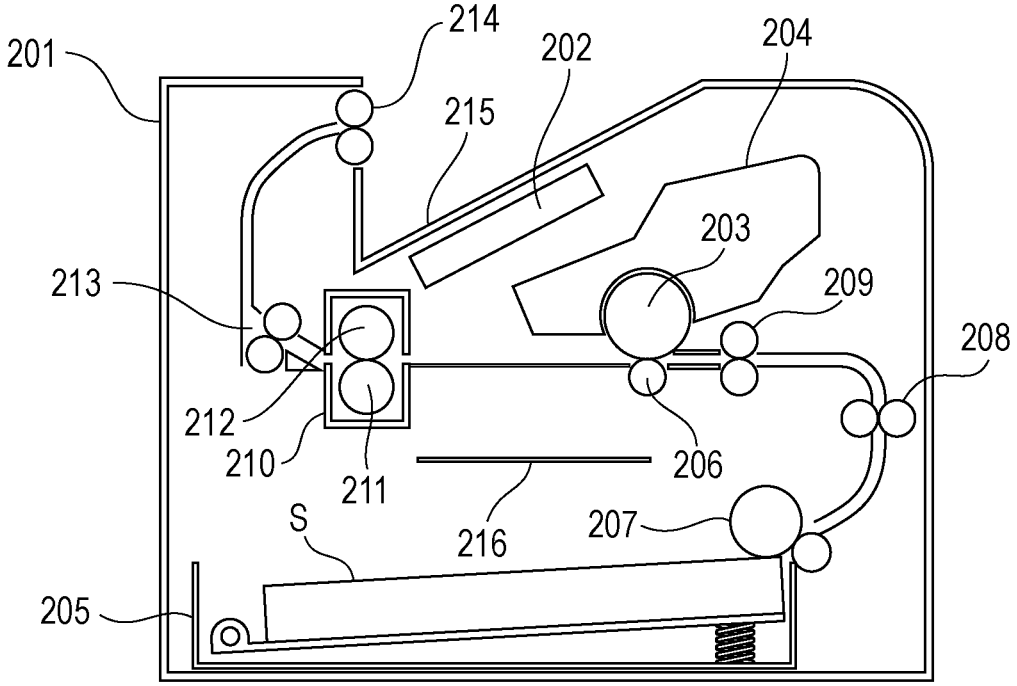
FIG. 4 is a cross-sectional view showing, in outline, the overall configuration of an image forming apparatus having the fixing unit according to the embodiments.

FIG. 4 shows the overall configuration of an image forming apparatus according to a first embodiment. A recording material S in a feeding cassette 205 is fed by a feeding unit 207 to a conveying roller pair 208. Next, an image forming unit that forms a toner image on the recording material S will be described. In this embodiment, the image forming unit includes an optical unit 202, a cartridge 204 having a photosensitive drum 203, and a transfer roller 206. The optical unit 202 forms a latent image on the photosensitive drum 203 according to image information. The latent image on the photosensitive drum 203 is developed by a developing unit (not shown) in the cartridge 204 and becomes a toner image. The recording material S, being timed with the toner image, is conveyed by a registration roller pair 209 to a transfer nip between the photosensitive drum 203 and the transfer roller 206. The toner image on the photosensitive drum 203 is transferred to the recording material S at the transfer nip, and thus, the toner image is formed on the recording material S.

The recording material S after passing through the image forming unit is sent to the fixing unit 210, where the toner image on the recording material is fixed onto the recording material. The recording material S after the fixing processing is discharged onto a discharge tray 215 by an inner discharge roller pair 213 and an outer discharge roller pair 214.

Figure 5:
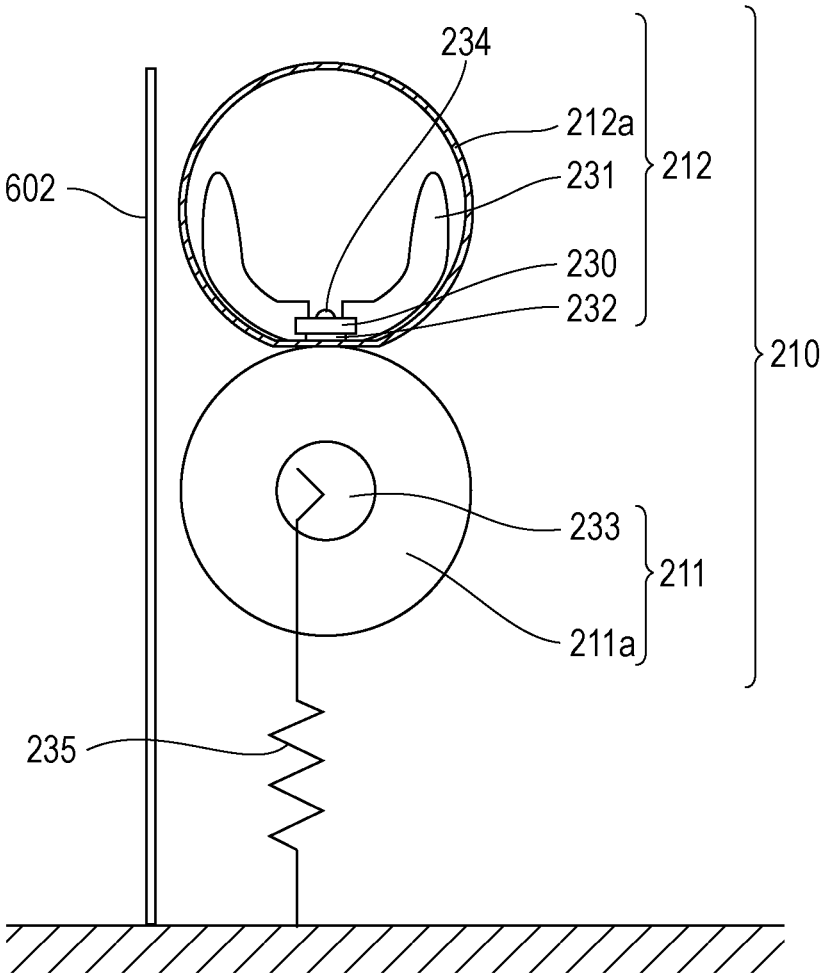
FIG. 5 is a cross-sectional view showing, in outline, the configuration of the fixing unit according to the embodiments.

Next, the fixing unit 210 according to the first embodiment will be described using the cross-sectional view in FIG. 5.

A tubular film 212*a* is externally fitted to a stay 231, which serves as a guide member for the film 212*a*. The film 212*a* is a composite laminate film formed of a base layer composed of, for example, polyamidoimide, PEEK, PES, or PPS, and a release layer composed of fluoroplastic, such as PTFE, PFA, or FEP, formed thereon by coating or by using a tube.

Herein, PEEK is polyetherether ketone, PES is polyether sulphone, PPS is polyphenylene sulfide, PTFE is polytetrafluoroethylene, PFA is tetrafluoroethylene-perfluoroalkyl vinyl ether copolymer, and FEP is tetrafluoroethylene-hexafluoropropylene copolymer.

The heater 230 includes an insulating substrate composed of, for example, alumina; an electric resistance material, which serves as a heat generating resistor, applied to the surface thereof; and an insulating layer that is composed of, for example, glass or plastic and serves as a protection layer 232 formed thereon.

Furthermore, a control unit (not shown) controls the power supplied to the heater 230 according to the temperature detected by a thermistor 234 provided on the heater 230, thereby controlling the temperature of the heater 230.

A pressing roller 211, which serves as a pressing member, is formed of a core 233, a rubber layer 211*a* that is composed of a heat-resistant conducting silicone sponge or the like and is provided on the core 233, and a release layer composed of a PFA tube provided on the surface. The pressing roller 211 is driven by a motor (not shown). The pressing roller 211 and the heater 230 form a nip therebetween via the film 212*a*, at which the recording material is heated while being conveyed. The shaft of the core 233 is electrically grounded to the FG via a high resistivity resistor 235.

A metal frame 602 of the fixing unit 210 is electrically grounded to the FG and is disposed at a predetermined distance from the film 212*a* and the pressing roller 211.

Furthermore, the film 212*a* may be regarded as being electrically connected to the rubber layer 211*a* and core 233 of the pressing roller 211 at a lower impedance than to the protection layer 232 of the heater 230.

Figure 6:
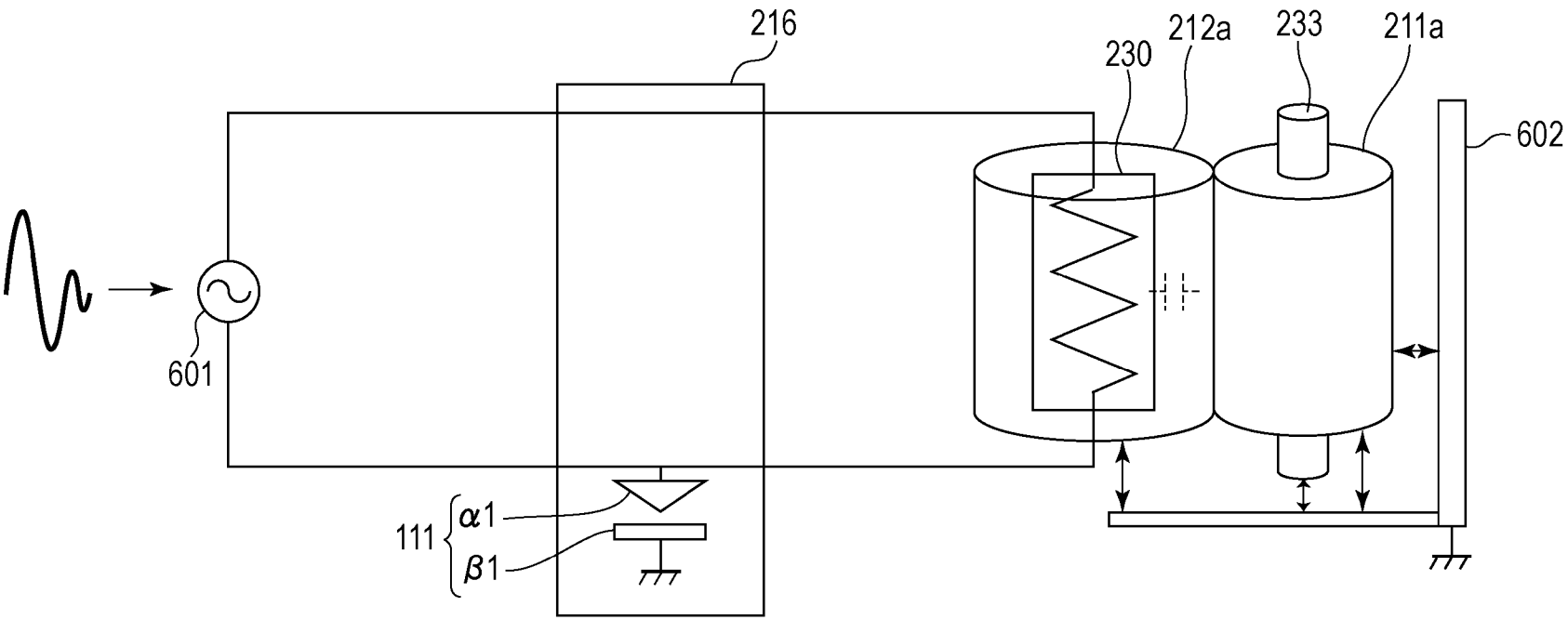
FIG. 6 is a diagram showing the configuration of an electric circuit from a power supply to the fixing unit according to the first embodiment.
Figure 7A:
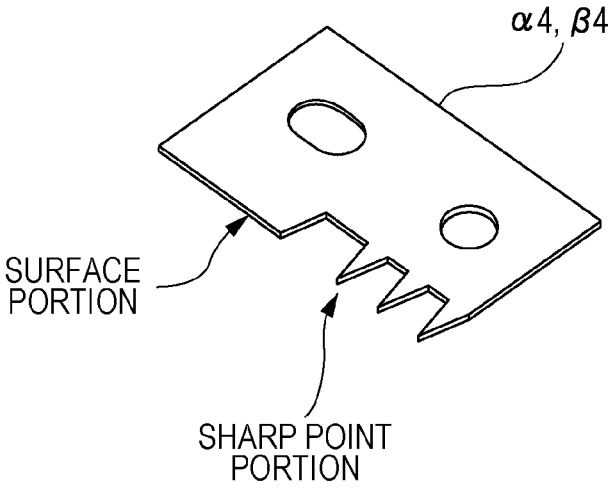
FIGS. 7A to 7D are diagrams showing, in outline, an arrester according to a fourth embodiment.
Figure 7B:
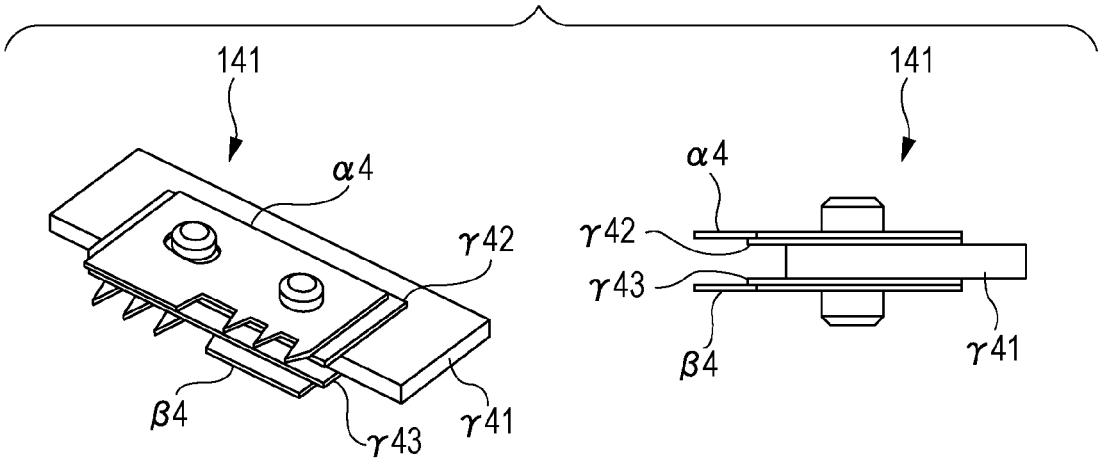
Figure 7C:
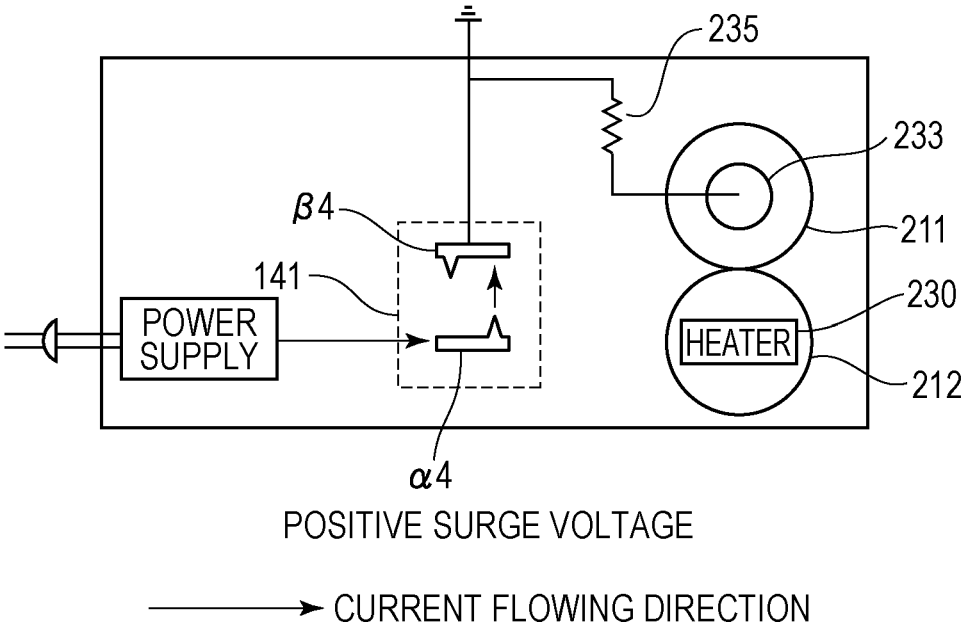
Figure 7D:
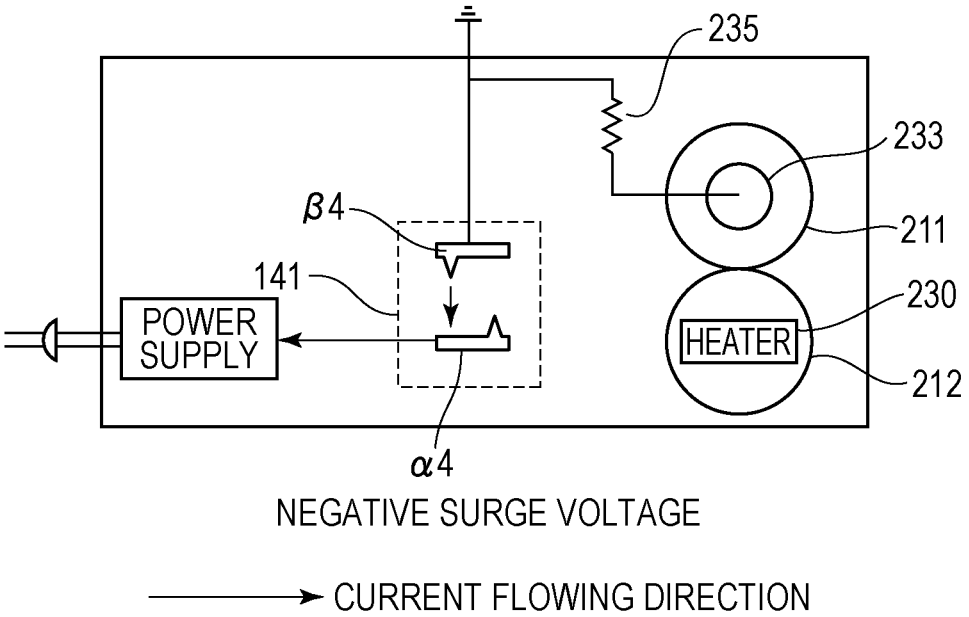

Next, referring to FIG. 6 showing the electric circuit from the power supply to the fixing unit according to the first embodiment, the configuration of an arrester 111 will be described.

The arrester 111 includes an electrode α1, which serves as a first electrode, and an electrode β1, which serves as a second electrode. The electrode α1 is connected to a power supply line leading from a power supply 601 to a heater (heat generating resistor), and the electrode β1 is grounded to the FG of the image forming apparatus 201.

Although the electrode α1 is attached to only one of the two power supply lines in the first embodiment, the electrode α1 may be attached to each of the two power supply lines. When the electrode α1 is attached to only one of the two power supply lines, as in this embodiment, the use of a surge absorber, such as a varistor, between the power supply lines is effective to suppress an increase in voltage in the other power supply line.

Next, using FIG. 1A, the configuration of the arrester 111 according to the first embodiment will be described in detail. In the first embodiment, the arrester 111 includes the electrode α1, which serves as the first electrode, and the electrode β1, which serves as the second electrode. The electrodes α1 and β1 are formed of plate-like conductors and are securely mounted to an electric circuit substrate 216, which serves as a holding member. Terminals of the electrodes α1 and β1 are soldered to patterns on the back surface of the electric circuit substrate 216 for electrical connection. The electrode α1 is disposed on a pattern through which power is supplied from the power supply to the heater 230. The electrode β1 is connected to a ground pattern on the electric circuit substrate 216 and, eventually, to an electrical ground of the image forming apparatus 201 (see FIG. 1B).

Figure 1B:
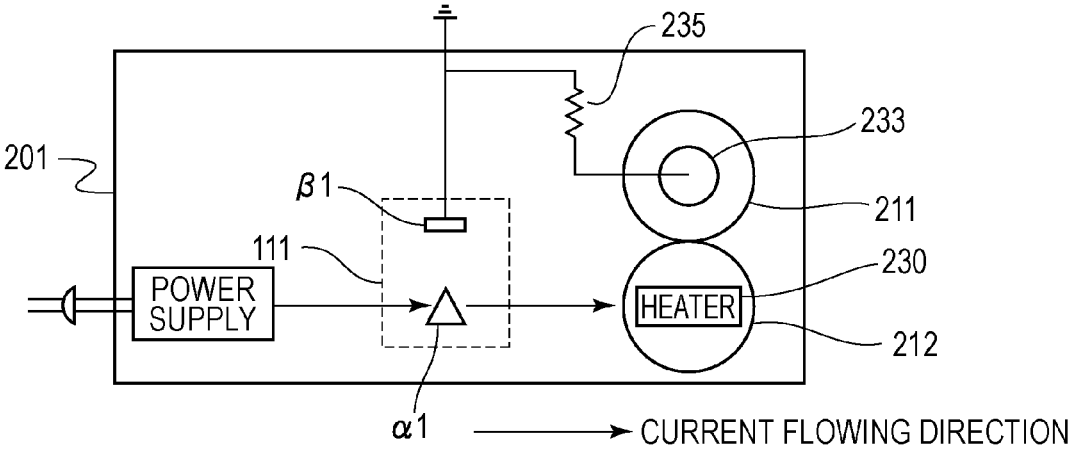
FIG. 1B is a schematic diagram showing the flow of an electric current in a power supply line in a fixing unit in the normal time according to the first embodiment.
Figure 1C:
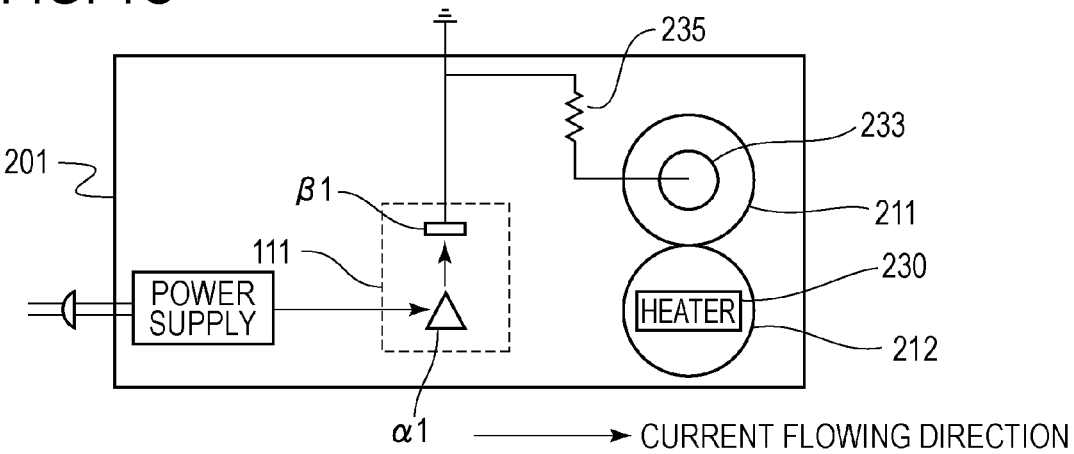
FIG. 1C is a schematic diagram showing the flow of an electric current in the power supply line in the fixing unit when a surge voltage is applied according to the first embodiment.

Furthermore, a sharp point portion P1 of the electrode α1 faces a surface portion Q1 of the electrode β1 with a predetermined clearance therebetween (hereinbelow, a distance X1 between electrodes). During normal fixing processing, the power supply 601 supplies an electric current to the heater (heat generating resistor), as shown in FIG. 1B. When a high-potential surge voltage is applied to the power supply line, a discharge is allowed to occur across the distance X1 between electrodes, and the surge voltage is guided to the electrical ground, as shown in FIG. 1C. This prevents the surge voltage from being applied to the protection layer 232 of the heater 230 on the downstream side of the electrode α1 in the power supply line, and thus, an electrical breakdown in the protection layer 232 of the heater 230, shown in FIG. 5, can be avoided.

Now, the relationship between the distance X1 between electrodes of the arrester 111 and the voltage at which a discharge starts to occur will be described. The voltage at which a discharge between the electrodes of the arrester 111 starts to occur changes depending on the distance X1 between electrodes. More specifically, the longer the distance X1 between electrodes, the higher voltage is needed to cause a discharge. This means that the voltage at which a discharge starts to occur can be controlled by controlling the distance X1 between electrodes. Roughly speaking, the discharge voltage increases by 1-kV every time the distance X1 between electrodes increases by 1 mm. Therefore, the accuracy of the distance X1 between electrodes, in other words, the positional accuracy of the electrode β1 with respect to the electrode α1 is important. Accordingly, in the first embodiment, the electrodes α1 and β1 are fixed to the electric circuit substrate 216, which serves as a holding member, to improve the positional accuracy of the electrode β1 with respect to the electrode α1.

In tests according to the international standards (IEC61000-4-5), a high voltage (4 kV or more), which serves as a surge voltage, may be applied between the power supply line and the FG. In the first embodiment, the case where a discharge is allowed to occur between the electrodes of the arrester 111 when a surge voltage of 4 kV is applied between the power supply line and the FG will be described.

In the configuration of the first embodiment, the tolerance of the distance X1 between electrodes is ±1.0 mm. When the nominal distance between electrodes is 3.0 mm, the distance between electrodes is in the range from 2.0 mm to 4.0 mm (the safety standards require at least 2.0 mm). Because a discharge occurs between the electrodes of the arrester 111 when a voltage of 2.0 kV to 4.0 kV is applied to the power supply line, a discharge occurs when a voltage of 4.0 kV is applied.

Note that the impedance of a first path leading from the power supply 601 to the FG at a point in which a discharge occurs between the electrodes of the arrester 111 (hereinbelow, a first impedance) must be the smallest of all the paths leading from the power supply 601 to the FG. Herein, the impedance of a second path leading from the power supply 601 to the FG at a point in which a discharge occurs across the clearance between the film 212*a* and the metal frame 602 (hereinbelow, a second clearance) is referred to as a second impedance. Furthermore, the impedance of a third path leading from the power supply 601 to the FG at a point in which a discharge occurs across the clearance between the pressing roller 211 and the metal frame 602 (a third clearance) is referred to as a third impedance. In order to allow a discharge to occur between the electrodes of the arrester 111 when a surge voltage is applied to the power supply line, the first impedance must be smaller than the second and third impedances. In other words, the second and third clearances must be set to satisfy the above-described relationship between the impedances. Basically, by making the second and third clearances equal to the distance X1 between electrodes, the above-described relationship between the impedances is satisfied. The reason for this is that because the second and third paths are grounded to the FG at a position downstream of the protection layer 232 of the heater 230, the impedance increases due to the presence of the protection layer 232 of the heater 230, which is composed of an insulating layer, such as glass or plastic. Accordingly, in the first embodiment, by setting the second and third clearances 4 mm, a discharge is allowed to occur between the electrodes of the arrester 111 when a surge voltage is applied, and thus, an electrical breakdown in the protection layer 232 of the heater 230 can be avoided.

The second and third clearances in the configuration of the first embodiment may be smaller than those of the conventional configuration that does not have an arrester. The reason for this is that because, in the first embodiment, the electrode α is located upstream of the heat generating resistor in the power supply line leading from the power supply 601, the impedance of the path leading to the FG across the electrodes of the arrester 111 can be made smaller than that of the conventional configuration.

As has been described above, the first embodiment enables a reduction in size of the apparatus and prevents an electrical breakdown in the protection layer 232 of the heater 230.

However, the distance between the electrodes does not always determine the ease of discharge. Depending on the shapes of discharging parts of the electrodes, the humidity, and the atmospheric pressure, the electric field distribution changes. Therefore, discharges do not always occur at positions where the distance between electrodes is short. Accordingly, in the first embodiment, the shape of the electrode α1 of the arrester 111 is pointed such that the electric field is easily concentrated.

The arrester 111 according to the first embodiment does not necessarily have to be disposed on the electric circuit substrate 216 to achieve the same advantage, as long as it is disposed at a position between the power supply line and the heat generating resistor.

Although the two electrodes are formed of plate-like conductors in the first embodiment, wire-like electrodes or rod-like electrodes may also be used to achieve the same advantage as the first embodiment. Furthermore, instead of the electric circuit (pattern) mounted on the electric circuit substrate 216, electrodes may be used to achieve the same advantage as the first embodiment.

In the first embodiment, the electrode α1 has the sharp point portion P1, and the electrode β1 has the surface portion Q1. However, the electrode α1, which serves as the first electrode, may have a surface portion, and the electrode β1, which serves as the second electrode, may have a sharp point portion.

Second Embodiment

Figure 2:
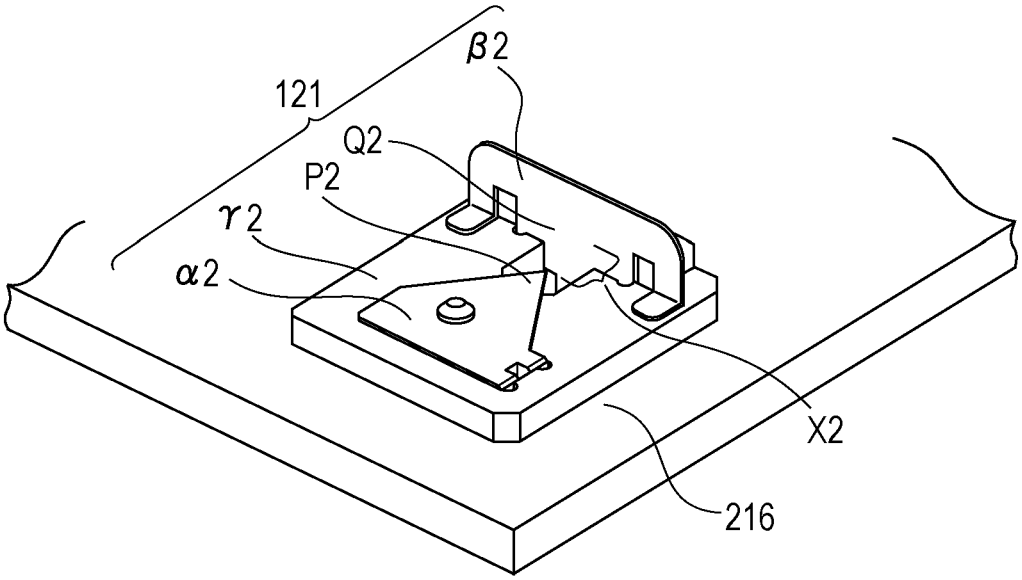
FIG. 2 is a diagram showing, in outline, an arrester according to a second embodiment.

FIG. 2 shows the configuration of an arrester 121 according to a second embodiment. The second embodiment differs from the first embodiment in that a holding member which supports the electrodes α2 and β2 is made of an insulator γ2 that has better dimensional accuracy than the electric circuit substrate 216 and that is fixed to the electric circuit substrate 216. Terminals of the electrodes α2 and β2 are electrically connected to a pattern on the back surface of the electric circuit substrate 216. The electrode α2 is connected to a pattern through which power is supplied from the power supply to the fixing unit 210. The electrode β2 is connected to a ground pattern on the electric circuit substrate 216 and, eventually, to the electrical ground of the image forming apparatus 201.

The configuration of the second embodiment is advantageous in that a distance X2 between electrodes is less likely to be affected, even when the electric circuit substrate 216 is made of an inexpensive material and is easily warped due to thermal expansion or is easily deformed due to lack of rigidity. This is because the electrodes α2 and β2 are fixed to the insulator γ2, and the distance X2 between electrodes is set. Thus, in the configuration of the second embodiment, the tolerance of the distance X2 between electrodes is ±0.5 mm, which is smaller than the first embodiment. Accordingly, when the nominal distance between electrodes is 2.5 mm, the distance between electrodes is in the range from 2.0 mm to 3.0 mm. When a voltage of 2.0 kV to 3.0 kV is applied to the power supply line, a discharge occurs between the electrodes of the arrester 111. By setting the clearance between the pressing roller 211 or the film 212*a* and the metal frame 602 3 mm, an electrical breakdown in the protection layer 232 of the heater 230 can be avoided. In this embodiment, because the metal frame 602 can be disposed at a position 1 mm closer to the film 212*a* and the pressing roller 211 than the first embodiment, the apparatus can be made even smaller.

Third Embodiment

Figure 3:
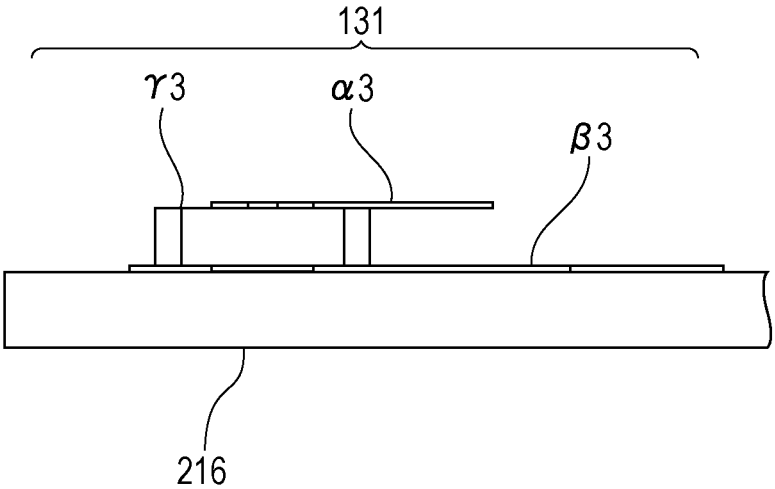
FIG. 3 is a diagram showing, in outline, an arrester according to a third embodiment.

The configuration of an arrester 131 according to a third embodiment will be described with reference to FIG. 3. In the arrester 131, an electrode β3 made of a plate-like conductor is securely mounted to the electric circuit substrate 216, and the electrode β3 and an electrode α made of a plate-like conductor are disposed facing each other, such that an insulator γ3 is disposed between the electrode β3 and a part of the electrode α3. The electrode α3 is also securely mounted to the electric circuit substrate 216.

Terminals of the electrodes α3 and β3 are soldered to patterns on the back surface of the electric circuit substrate 216 for electrical connection. The electrode α3 is connected to the pattern through which power is supplied from the power supply to the fixing unit 210, and the electrode β3 is connected to the ground pattern on the electric circuit substrate 216 and, eventually, to the electrical ground of the image forming apparatus 201.

The distance between a surface portion P3 of the electrode α3 and a surface portion Q of the electrode β3 depends on the dimensional accuracy of the insulator γ1. Accordingly, by improving the dimensional accuracy of the insulator γ3, the tolerance of the distance between electrodes can be reduced, thereby contributing a reduction in size.

Fourth Embodiment

FIGS. 7A to 7D show the configuration of an arrester 141 according to a fourth embodiment. The arrester 141 includes an electrode α4, which is made of a plate-like conductor and serves as a first electrode, an electrode β4, which serves as a second electrode, an insulator γ41, and insulating sheets γ42 and γ43. The electrode β4 is securely mounted to the electric circuit substrate 216, and the electrode α4 is disposed parallel to the electrode β4 with the insulating sheet γ43, the insulator γ41, and the insulating sheet γ42 therebetween. The electrode α4 is also securely mounted to the electric circuit substrate 216.

Terminals of the electrodes α4 and β4 are soldered to patterns on the back surface of the electric circuit substrate 216 for electrical connection. The electrode α4 is connected to the pattern (power supply line) through which power is supplied from the power supply to the heater 230. The electrode β4 is connected to the ground pattern on the electric circuit substrate 216 and, eventually, to the electrical ground of the image forming apparatus 201.

The electrodes α4 and β4 each have a sharp point portion and a surface portion. The electrodes α4 and β4 are disposed such that the sharp point portion of the electrode α4 faces the surface portion of the electrode β4 and such that the surface portion of the electrode α4 faces the sharp point portion of the electrode β4.

The direction of discharge changes depending on whether the surge voltage is positive or negative. A discharge tends to occur from the sharp point portion to the surface portion. When the surge voltage is positive, a discharge occurs from the sharp point portion of the electrode α4 to the surface portion of the electrode β4, and when the surge voltage is negative, a discharge occurs from the sharp point portion of the electrode β4 to the surface portion of the electrode α4. In the configuration of the fourth embodiment, because the electrodes α4 and β4 are arranged symmetrically, a change in discharge voltage occurs can be reduced when the direction of discharge is changed depending on whether the surge voltage is positive or negative.

The distance between the surface portion P4 of the electrode α4 and the surface portion Q4 of the electrode β4 depends on the dimensional accuracy of the insulator γ41 and the insulating sheets γ42 and γ43. Accordingly, by improving the dimensional accuracy of these components, the tolerance of the distance between electrodes can be reduced, thereby contributing a reduction in size.

Figure 8A:
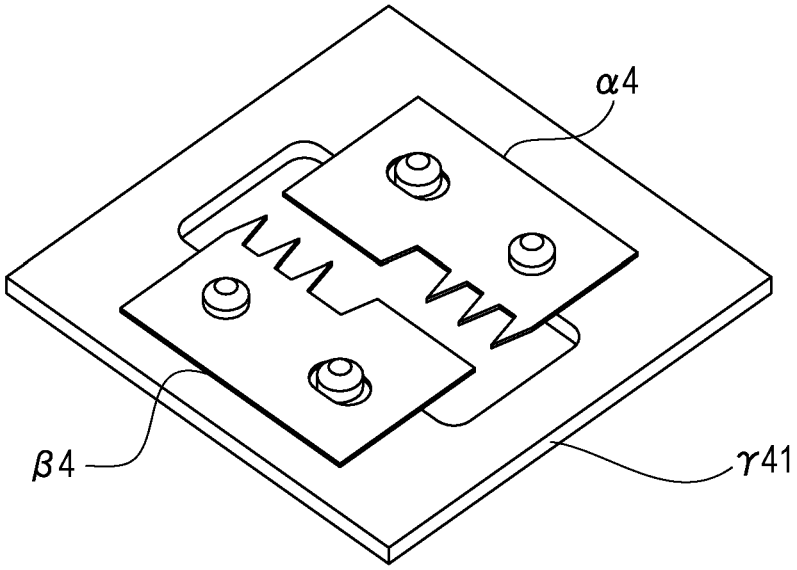
FIGS. 8A and 8B show a modification of the fourth embodiment.
Figure 8B:
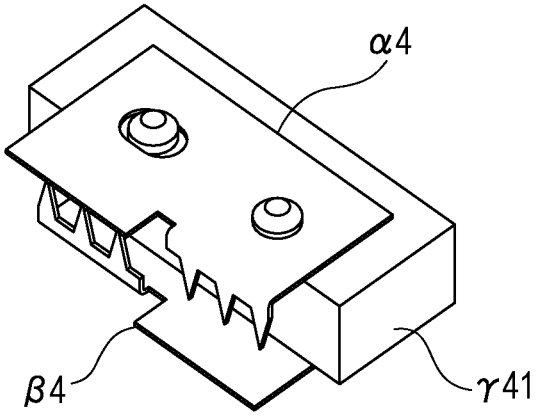

Although the electrodes α4 and β4 are arranged parallel to each other in the fourth embodiment, the arrangement of the electrodes α4 and β4 is not limited to this. The arrangement shown in FIGS. 8A and 8B, which show a modification of the fourth embodiment, may also be employed to reduce a change in discharge voltage due to whether the surge voltage is positive or negative.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-151922 filed Jul. 8, 2011 and No. 2012-134111 filed Jun. 13, 2012, which are hereby incorporated by reference herein in their entirety.

What is claimed is:

1. An image forming apparatus configured to form an image on a recording material, the apparatus comprising:

a fixing unit configured to fix the image onto the recording material, the fixing unit including a heater;

a power supply line configured to connect electrically the heater with a power supply for supplying power to the heater;

a first electrode connected to the power supply line between the power supply and the heater;

a second electrode connected to an electrical ground, the second electrode not being in contact with the first electrode; and an insulation holder configured to hold the first electrode and the second electrode, wherein one of the first electrode and the second electrode has a sharp point portion and the other has a facing portion facing the sharp point portion with a predetermined clearance therebetween, the sharp point portion floating in the air.

2. The image forming apparatus according to claim 1, wherein the insulation holder is an electric circuit substrate for driving the heater.

3. The image forming apparatus according to claim 1, wherein the insulation holder is mounted on an electric circuit substrate for driving the heater.

4. The image forming apparatus according to claim 1, wherein the fixing unit includes a tubular film and the heater contacts an inner surface of the film, and wherein the heater includes a substrate, a heat generating resistor formed on the substrate and is connected to the power supply line, and an insulating layer that covers the heat generating resistor and contacts the inner surface of the film.

5. The image forming apparatus according to claim 1, wherein the insulation holder has an opening so as to float the sharp point portion in the air.

6. The image forming apparatus according to claim 1, wherein an impedance of a first path leading from the power supply to the electrical ground via the first electrode and the second electrode is smaller than an impedance of a second path leading from the power supply to the electrical ground via the heater.

7. The image forming apparatus according to claim 1, wherein the predetermined clearance is set so as to prevent an electrical breakdown of the heater when a high-potential surge voltage is applied to the power supply line.

8. The image forming apparatus according to claim 1, wherein the first electrode and the second electrode are formed of plate-like conductors, the second electrode being arranged so as to intersect with the first electrode at right angles.

9. The image forming apparatus according to claim 1, wherein the facing portion is a flat surface.

10. An image forming apparatus configured to form an image on a recording material, the apparatus comprising:

a fixing unit configured to fix the image onto the recording material, the fixing unit including a heater;

a power supply line configured to connect electrically the heater with a power supply for supplying power to the heater;

a first electrode connected to the power supply line between the power supply and the heater;

a second electrode connected to an electrical ground, the second electrode not being in contact with the first electrode; and an insulation holder configured to hold the first electrode and the second electrode, wherein the first electrode is held on a surface of the insulation holder and the second electrode is held on a surface of the insulation holder opposite to the surface on which the first electrode is held, and wherein one of the first electrode and the second electrode has a sharp point portion and the other has a facing portion facing the sharp point portion with a predetermined clearance therebetween, the sharp point portion and the facing portion overhanging from an end of the insulation holder to the outside so as to float the sharp point portion in the air.

11. The image forming apparatus according to claim 10, wherein an impedance of a first path leading from the power supply to the electrical ground via the first electrode and the second electrode is smaller than an impedance of a second path leading from the power supply to the electrical ground via the heater.

12. The image forming apparatus according to claim 11, the predetermined clearance is set so as to prevent an electrical breakdown of the heater when a high-potential surge voltage is applied to the power supply line.

13. The image forming apparatus according to claim 12, wherein the first electrode and the second electrode are formed of plate-like conductors, the second electrode being arranged parallel with the first electrode.

14. The image forming apparatus according to claim 13, wherein the insulation holder is an electric circuit substrate for driving the heater.

15. The image forming apparatus according to claim 14, wherein the insulation holder is mounted on an electric circuit substrate for driving the heater.

16. The image forming apparatus according to claim 15, wherein the facing portion is a flat surface.

* * * * *